US005213268A

United States Patent [19]

Gnauert et al.

[11] Patent Number: 5,213,268

[45] Date of Patent: May 25, 1993

[54] SPRAYER FAUCET WITH ANTIBACKFLOW PROTECTION

[75] Inventors: Werner Gnauert, Iserlohn; Frank-Thomas Luig, Fröndenberg, both of Fed. Rep. of Germany

[73] Assignee: Friedrich Grohe Aktiengesellschaft, Hemer, Fed. Rep. of Germany

[21] Appl. No.: 813,367

[22] Filed: Dec. 24, 1991

[30] Foreign Application Priority Data

Jan. 12, 1991 [DE] Fed. Rep. of Germany ..... 4100801

[51] Int. Cl.[5] ..... B05B 1/00

[52] U.S. Cl. ..... 239/571; 239/574; 239/588; 4/677; 137/218; 137/526

[58] Field of Search ..... 239/588, 571, 574; 4/677; 137/217, 218, 526

[56] References Cited

U.S. PATENT DOCUMENTS

| | | | |
|---|---|---|---|
| Re. 26,235 | 7/1967 | Woodford | 137/218 |
| 2,040,846 | 5/1936 | Hesselman | 239/574 |
| 3,926,375 | 12/1975 | Reeder et al. | 239/574 |
| 4,827,538 | 5/1989 | Heimann et al. | 137/526 |

FOREIGN PATENT DOCUMENTS

| | | | |
|---|---|---|---|
| 989271 | 5/1976 | Canada | 137/217 |
| 0339104 | 11/1989 | European Pat. Off. . | |
| 1144209 | 2/1963 | Fed. Rep. of Germany . | |
| 3124214 | 1/1983 | Fed. Rep. of Germany | 4/677 |
| 3805462 | 8/1989 | Fed. Rep. of Germany . | |
| 3812549 | 10/1989 | Fed. Rep. of Germany . | |
| 8908214.1 | 10/1989 | Fed. Rep. of Germany . | |
| 2011584 | 7/1979 | United Kingdom . | |

*Primary Examiner*—Andres Kashnikow
*Assistant Examiner*—Lesley D. Morris
*Attorney, Agent, or Firm*—Herbert Dubno; Andrew Wilford

[57] ABSTRACT

A faucet assembly has a housing formed with a vent passage extending between inlet and vent ports and a feed passage extending between an outlet port and a location in the vent passage between the inlet and vent ports. An inner valve body is displaceable in the vent passage between an inner end position sitting in an inner valve seat at the inlet port and blocking flow out of the vent passage through the inlet port and an outer end position sitting in an outer seat and blocking flow from the location toward the vent port. Similarly an outer valve body is displaceable in the vent passage between an outer end position sitting in a vent seat at the vent port and blocking flow out of the vent passage through the vent port and an inner end position permitting flow through the vent port. A mixing valve normally feeds water under pressure to the inlet port and thereby presses the inner valve body into the outer position and, in an abnormal pressure-reversal situation, applies a subatmospheric pressure to the inlet port and thereby moves the inner valve body into the inner position. A faucet arm on the housing carries a removable spray head and a hose has one end connected to the spray head and an opposite end connected to the outlet port of the housing.

6 Claims, 3 Drawing Sheets

SPRAYER FAUCET WITH ANTIBACKFLOW PROTECTION

FIELD OF THE INVENTION

The present invention relates to a valve/faucet fixture. More particularly this invention concerns such a fixture having a sprayer-type faucet and antibackflow protection.

BACKGROUND OF THE INVENTION

A sprayer-type faucet assembly or fixture has a faucet whose head or outlet end normally sits on a faucet arm to give the device the appearance and function of a standard faucet that dispenses water when the associated valve is opened. In addition the head can be pulled from the support arm to work as a sprayer. To this end the head is connected via a flexible hose that extends back down through the arm to the valve, normally forming a loop under the deck to provide some range of movement for the spray head. Such an arrangement is extremely convenient in that it eliminates the need for a separate sprayer attachment and it allows convenient switchover from mobile spray to fixed faucet. It can be used in a standard kitchen sink, in a beauty-shop setting, and or in any type of application where a sprayer might be needed in addition to a faucet.

The primary disadvantage of such a system, as opposed to the standard nonextensible faucet, is that the spray head can be left in the sink, in fact below the surface of the water therein If the valve is still open and there is a momentary pressure reversal, that is the supply pressure momentarily drops below atmospheric, it is therefore possible for such an arrangement to suck in water from the sink, contaminating the clean water in the supply lines This possibility is an illegal situation that plumbing codes specifically forbid To avoid this, U.S. Pat. No. 4,827,538 proposes that the pressurizable feed passage that extends from the outlet side of the valve to the inlet end of the hose is provided with a vent valve. This vent valve is constituted as a one-way or check valve provided in a passage having one end opening into the pressurizable feed passage and an opposite vent end opening outside the assembly and set up to normally block flow out the vent end. So long as the feed passage remains pressurized, this vent valve stays closed If pressure in the feed passage drops below atmospheric, however, the vent opens and allows the feed passage to suck in air, not the water in the hose and any water in which the outlet end of the hose is submerged in. Thus in the event of a pressure reversal, the supply line will merely suck in air.

In German patent document 3,805,462 of W. Gnauert (U.S. equivalent abandoned applications 07/301,638 and 07/458,171) such a system is described wherein instead of a single-element check valve serving as vent valve, two cascaded valves are used. This system avoids sprayback when the vent is operated or when pressure is first applied to the feed passage.

With these systems it is necessary to provide a separate restriction or check valve in the supply or feed line in order to limit the intake of air during backflow. This supplementary valve, which is necessary to prevent the aspiration of any liquid in the hose, increases the cost and size of the faucet assembly.

OBJECTS OF THE INVENTION

It is therefore an object of the present invention to provide an improved sprayer-type faucet.

Another object is the provision of such an improved sprayer-type faucet which overcomes the above-given disadvantages, that is which has good antibackflow protection but that is still of simple and compact construction.

SUMMARY OF THE INVENTION

A faucet assembly according to this invention has a housing formed with an inlet port, an outlet port, and a vent port and with a vent passage extending between the inlet and vent ports and a feed passage extending between the outlet port and a location in the vent passage between the inlet and vent ports. An inner valve seat is provided in the vent passage between the location and the inlet port, a vent valve seat is provided in the vent passage between the location and the vent port, and an outer valve seat is provided in the vent passage between the location and the vent seat. An inner valve body is displaceable in the vent passage between an inner end position sitting in the inner seat and blocking flow out of the vent passage through the inlet port and an outer end position sitting in the outer seat and blocking flow from the location to the vent port. Similarly an outer valve body is displaceable in the vent passage between an outer end position sitting in the vent seat and blocking flow out of the vent passage through the vent port and an inner end position permitting flow through the vent port. The valve bodies are biased into the respective outer positions. A mixing valve normally feeds water under pressure to the inlet port and thereby presses the inner valve body into the outer position and, in an abnormal pressure-reversal situation, applies a subatmospheric pressure to the inlet port and thereby moves the inner valve body into the inner position. A faucet arm on the housing carries a removable spray head and a hose has one end connected to the spray head and an opposite end connected to the outlet port of the housing.

With this system therefore the two valves serve the triple function of blocking flow out through the vent port during normal operation and, during an abnormal pressure-reversal situation, permitting inflow through the vent port while preventing back flow into the inlet port. The inner valve body thus serves two different functions, thereby eliminating the need for a separate backflow-preventing valve. At the same time the use of two cascaded check valves, which according to this invention are of substantially identical construction and size, eliminates any possibility of the system spraying and leaking when pressure is suddenly turned on and off.

According to another feature of this invention the vent passage is straight and centered on an axis and the valve bodies are axially movable between the respective end positions. Furthermore the axis is vertical and the outer body is below the inner body, the weights of the bodies constituting the biasing unit. The bodies are balls.

Furthermore in accordance with this invention the vent passage is provided with a liner sleeve forming the seats and provided with a radially throughgoing opening at the location. The housing is formed with a stepped bore constituting the vent passage and having a shoulder on which the liner sleeve sits. The valve sits atop the housing and retains the sleeve in the bore.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
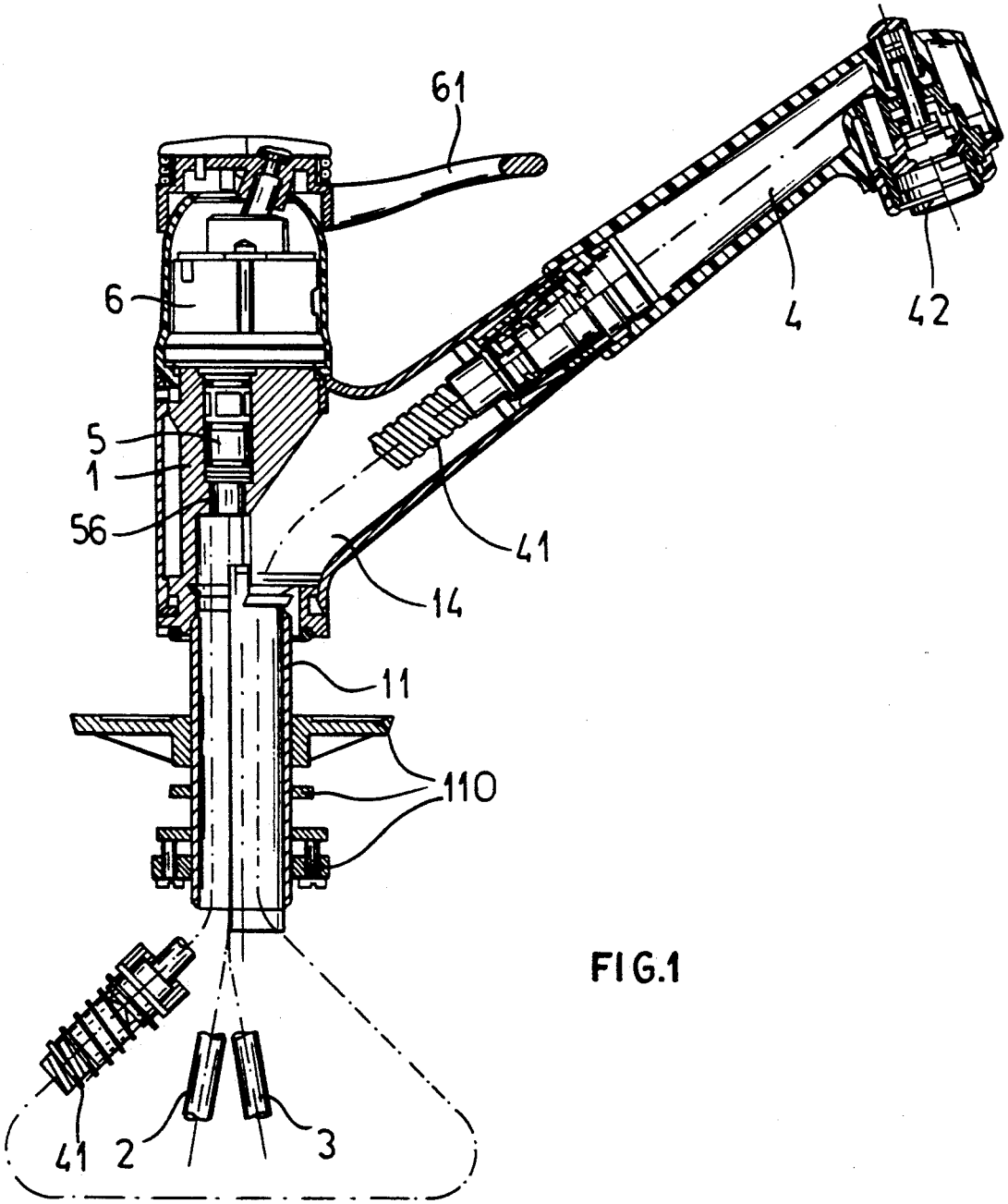
FIG. 1 is a vertical section through a sprayer-type faucet assembly according to the invention.

As seen in FIG. 1 a faucet assembly according to this invention has a housing 1 carrying on its upper side a standard single-control mixing valve 6 and connected on its lower side to hot- and cold-water supply lines 2 and 3. The valve 6 has a single control lever 61 that is raised and lowered to vary the flow cross section of the valve 6 and moved from side to side to change the mix of hot and cold water that is fed to an inlet port 55 of a vent passage 13 (FIGS. 2 and 3) formed in the housing 1. A tubular and externally threaded mounting sleeve 11 extends downward from the housing 1 and normally extends through a single hole in a deck on which the faucet is to be mounted, with a nut assembly 110 provided on the sleeve 11 to fix the unit in place.

A feed conduit 12 extends from an outlet port 59 that in turn opens via a feed passage 58 into the vent passage 13. This feed conduit 12 is connected to the inlet end of a hose 41 that extends back up through a support arm 14 pivoted on the housing 1 to a sprayer-type head 4 having a button-operated aerator 42. The hose 41 forms a loop beneath the deck on which the faucet is mounted so the spray head 4 can be pulled off the arm 14 and moved about in the manner well known per se.

Figure 2:
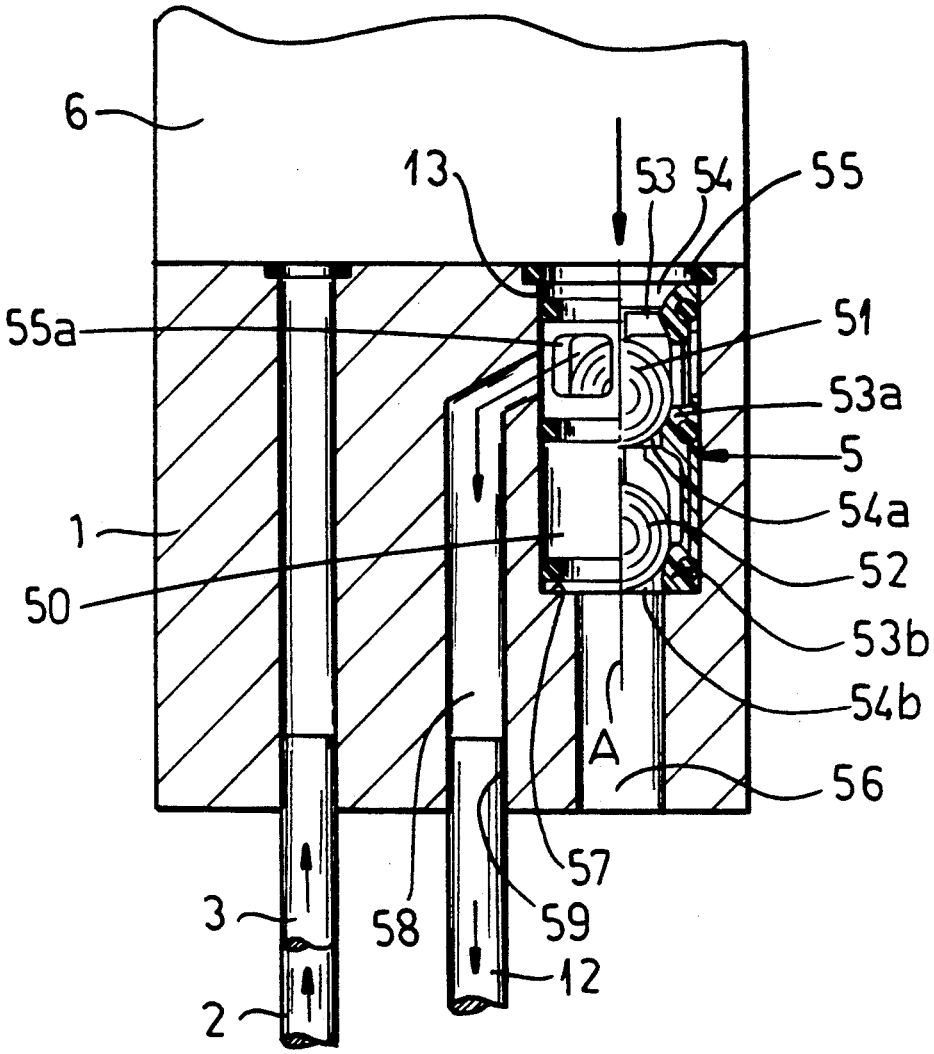
FIGS. 2 and 3 are large-scale vertical sections through the vent valve of the assembly respectively in the normal and venting positions.
Figure 3:
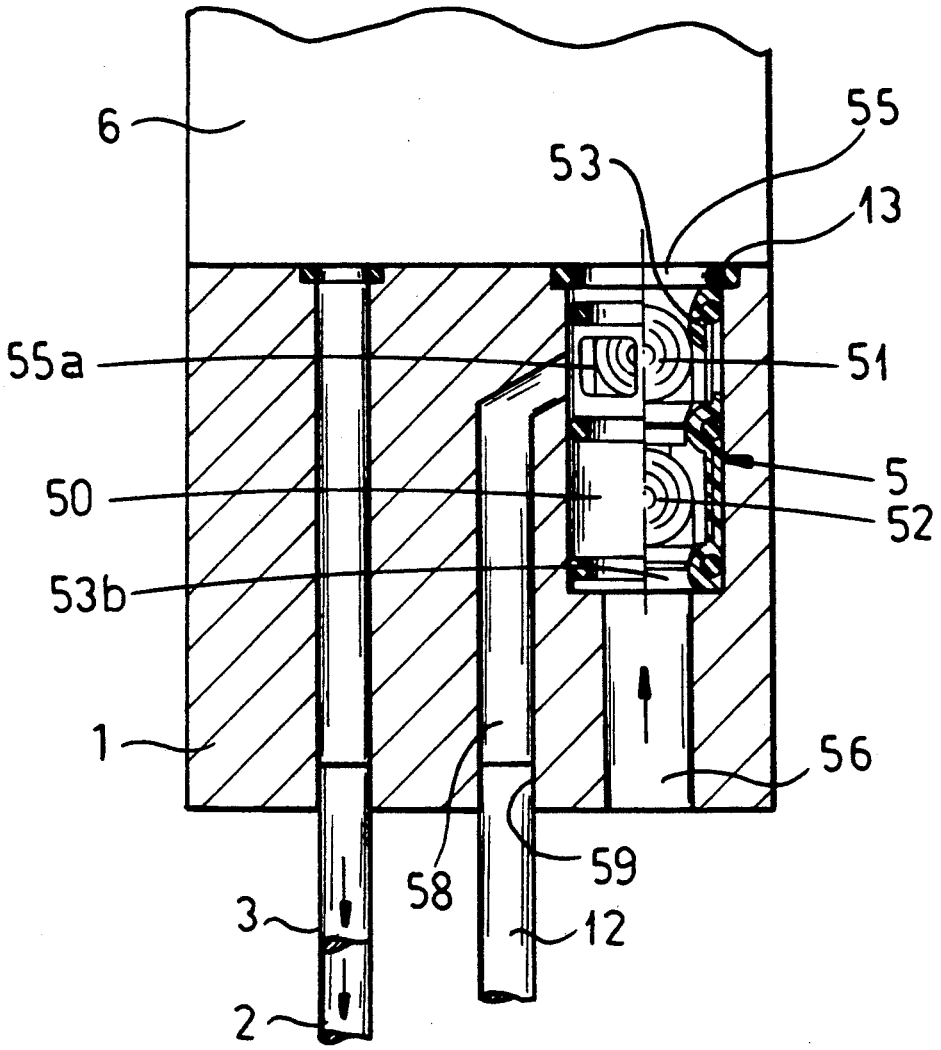

As best seen in FIGS. 2 and 3 a dual-element vent valve 5 is provided in the housing 1 in the vent passage 13 along the flow path from the valve 6 to the hose 41. To this end the vent passage 13 is stepped with a vertically downwardly opening lower end of small diameter forming a vent port 56 and a larger-diameter upper end forming the inlet port 55. The feed passage 58 opens radially of an axis A of this vent passage 13 just below the inlet port 55 into the large-diameter upper end of this passage 13.

A cylindrical valve sleeve 50 snugly received in the upper large-diameter portion of the vent passage 13 sitting on a shoulder 57 therein forms immediately beneath the inlet port 55 an inner seat 53 defining an opening 54, therebelow an outer seat **53*a* defining an opening 54*a*, and therebelow a vent seat 53*b* defining an opening 54*b*. An upper ball or inner valve body 51 is displaceable between the seats 53 and 53*a* and can seal therewith and a lower ball or outer valve body 52 is displaceable between the seats 53*a* and 53*b* but can only seal on the latter. The sleeve 50 is formed with radially throughgoing apertures 55*a* level with the location at which the feed passage 58 opens into the vent passage 13**.

Under normal circumstances as shown in FIG. 2 the line 2 and/or 3 is pressurized and the valve 6 is open to pressurize the inlet port 55. Gravity and the pressure of the liquid in the vent passage 13 bias the ball 51 down on the seat **53*a* to block the opening 54*a* for flow along the feed passage 58 and hose 41 to the head 4. The valve body 52 is biased by gravity on the seat 53*b*, blocking the opening 54*b***.

FIG. 3 shows what happens when the lines 2 and/or 3 are depressurized to apply through the valve 6 a subatmospheric pressure to the port 55. The body 51 is sucked upward to seat in the seat 53 and block the opening 54, thereby preventing flow back through the valve 6 to the feed lines 2 and/or 3. Simultaneously the body 52 is lifted off the seat **53*b* to unblock the opening 54*b*, thereby depressurizing the feed passage 58 and hose 41** and normally also causing them to drain.

We claim:

1. A faucet assembly comprising:

a housing formed with an inlet port, an outlet port, and a vent port and with a vent passage extending between the inlet and vent ports and a feed passage extending between the outlet port and a location in the vent passage between the inlet and vent ports;

an inner valve seat in the vent passage between the location vent-passage and the inlet port;

a vent valve seat in the vent passage between the location vent-passage and the vent port;

an outer valve seat in the vent passage between the location vent-passage and the vent seat;

an inner valve body displaceable in the vent passage between an inner end position sitting in the inner seat and blocking flow out of the vent passage through the inlet port and an outer end position sitting in the outer seat and blocking flow from the location vent-passage to the vent port;

an outer valve body displaceable in the vent passage between an outer end position sitting in the vent seat and blocking flow out of the vent passage through the vent port and an inner end position permitting flow through the vent port;

biasing means urging the valve bodies into the respective outer positions;

means including a valve for normally feeding water under pressure to the inlet port and thereby pressing the inner valve body into the outer position and for, in an abnormal pressure-reversal situation, applying a subatmospheric pressure to the inlet port and thereby moving the inner valve body into the inner position;

a faucet arm on the housing;

a spray head removably carried on the faucet arm; and a hose having one end connected to the spray head and an opposite end connected to the outlet port of the housing.

2. The sprayer-type faucet assembly defined in claim 1 wherein the vent passage is straight and centered on an axis and the valve bodies are axially movable between the respective end positions.

3. The sprayer-type faucet assembly defined in claim 2 wherein the axis is vertical and the outer body is below the inner body, the weights of the bodies constituting the biasing means.

4. The sprayer-type faucet assembly defined in claim 3 wherein the bodies are balls

5. The sprayer-type faucet assembly defined in claim 2 wherein the vent passage is provided with a liner sleeve forming the seats and provided with a radially throughgoing opening at the location vent-passage.

6. The sprayer-type faucet assembly defined in claim 5 wherein the housing is formed with a stepped bore constituting the vent passage and having a shoulder on which the liner sleeve sits, the valve sitting atop the housing and retaining the sleeve in the bore.

* * * * *